US008191998B2

(12) United States Patent
Shibata et al.

(10) Patent No.: US 8,191,998 B2
(45) Date of Patent: Jun. 5, 2012

(54) LIQUID EJECTING HEAD

(75) Inventors: Kazuaki Shibata, Oita (JP); Hirokazu Komuro, Yokohama (JP); Takuya Hatsui, Tokyo (JP); Takahiro Matsui, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 421 days.

(21) Appl. No.: 12/482,010

(22) Filed: Jun. 10, 2009

(65) Prior Publication Data

US 2009/0309933 A1 Dec. 17, 2009

(30) Foreign Application Priority Data

Jun. 17, 2008 (JP) ..... 2008-157876

(51) Int. Cl.
*B41J 2/045* (2006.01)

(52) U.S. Cl. ..... 347/71; 29/890.1

(58) Field of Classification Search ..... 347/71; 29/890.1

See application file for complete search history.

(56) References Cited

U.S. PATENT DOCUMENTS

| | | | | |
|---|---|---|---|---|
| 5,257,042 | A * | 10/1993 | Buhler | 347/64 |
| 5,478,606 | A | 12/1995 | Ohkuma et al. | |
| 6,139,761 | A | 10/2000 | Ohkuma | |
| 6,264,309 | B1 | 7/2001 | Sullivan | |
| 6,367,915 | B1 * | 4/2002 | Gooray et al. | 347/54 |
| 6,543,884 | B1 * | 4/2003 | Kawamura et al. | 347/65 |
| 6,663,229 | B2 | 12/2003 | Komuro et al. | |
| 6,969,154 | B2 | 11/2005 | Takeuchi et al. | |
| 7,287,847 | B2 | 10/2007 | Fujii et al. | |
| 7,364,284 | B2 * | 4/2008 | Hatsui et al. | 347/86 |
| 7,591,071 | B2 | 9/2009 | Ibe et al. | |
| 2003/0122594 | A1 * | 7/2003 | Tada | 327/108 |
| 2003/0137562 | A1 * | 7/2003 | Kawamura et al. | 347/65 |
| 2004/0012662 | A1 * | 1/2004 | Kneezel et al. | 347/93 |
| 2005/0285916 | A1 * | 12/2005 | Koyama et al. | 347/86 |
| 2006/0171823 | A1 * | 8/2006 | Chikamoto et al. | 417/412 |
| 2006/0238558 | A1 * | 10/2006 | Hatasa et al. | 347/20 |
| 2007/0216744 | A1 * | 9/2007 | Koike et al. | 347/100 |
| 2007/0285459 | A1 * | 12/2007 | Hatsui et al. | 347/20 |
| 2008/0076197 | A1 * | 3/2008 | Komuro et al. | 438/21 |
| 2009/0033718 | A1 * | 2/2009 | Faase et al. | 347/54 |

FOREIGN PATENT DOCUMENTS

| | | |
|---|---|---|
| EP | 0 609 860 | 6/1998 |
| EP | 0 750 992 | 6/2002 |
| EP | 0 924 077 | 6/2005 |
| JP | 6-286149 | 10/1994 |
| JP | 9-11479 | 1/1997 |
| JP | 2000-94700 | 4/2000 |
| JP | 2000094700 A * | 4/2000 |
| JP | 2005-178364 | 7/2005 |

* cited by examiner

*Primary Examiner* — Charlie Peng
*Assistant Examiner* — Peter Radowski
(74) *Attorney, Agent, or Firm* — Fitzpatrick, Cella, Harper & Scinto

(57) ABSTRACT

A compact print head enabling high-quality, high-speed printing is provided. A liquid ejecting head includes: a substrate, having elements that generate energy used to eject liquid from ejection openings, and provided with a liquid supply port that communicates with a surface of the substrate having the elements and an opposite surface thereof; a member, provided above the surface of the substrate, and having walls of a liquid flow path that communicates with ejection openings and the supply port; an insulating layer, provided so as to cover the supply port, and provided with a plurality of through-holes; and a conducting layer electrically coupled to the elements, and provided within the insulating layer so as to be insulated with respect to the liquid.

7 Claims, 8 Drawing Sheets

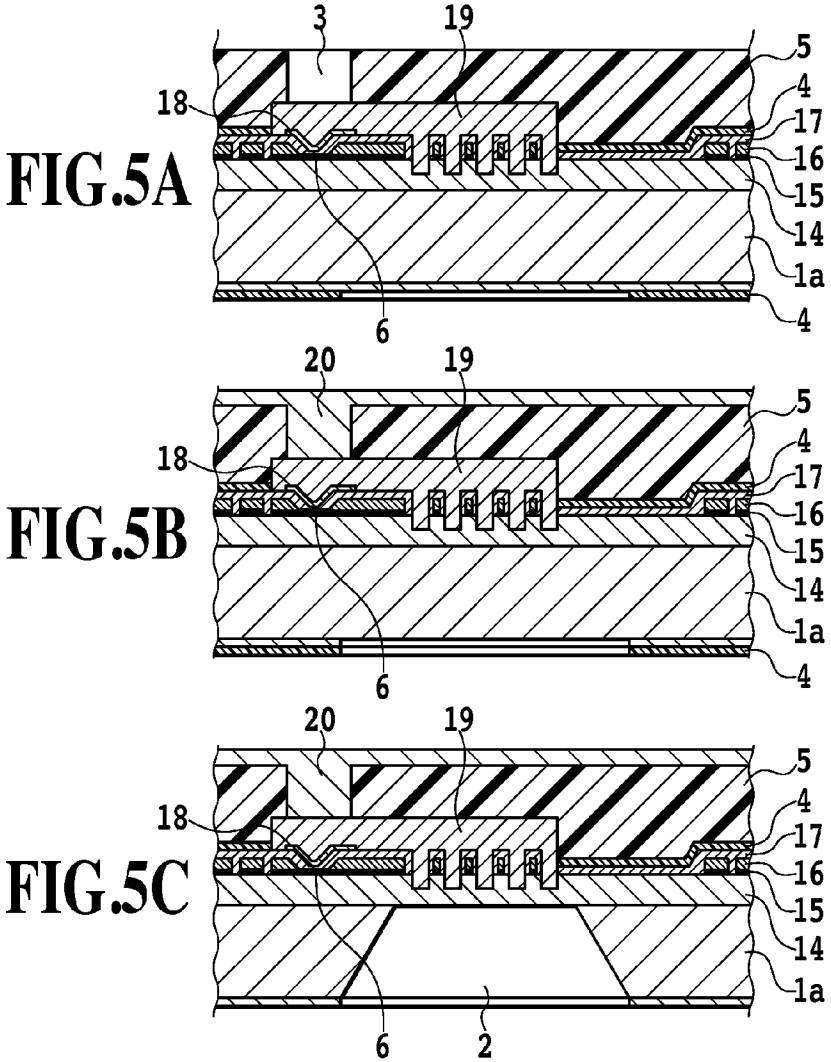
FIG.5A
FIG.5B
FIG.5C
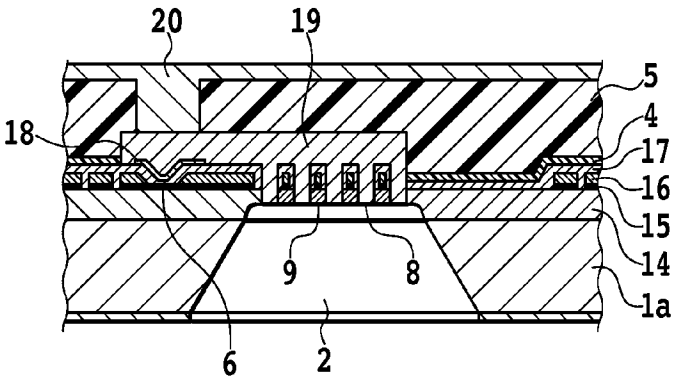
FIG.5D
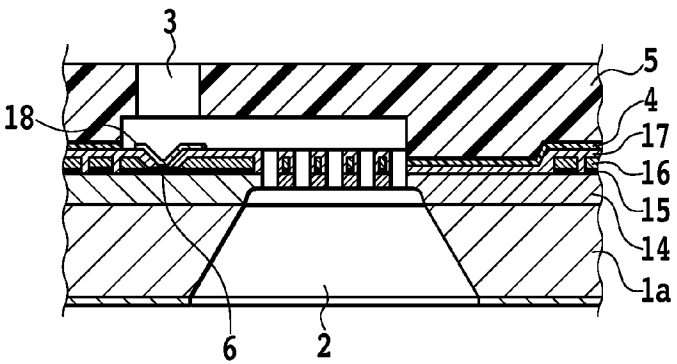
FIG.5E

LIQUID EJECTING HEAD

BACKGROUND OF THE INVENTION

1. Field of the Invention

The present invention relates to a liquid ejecting head. In particular, the present invention relates to an ink jet printing head effecting printing by ejecting ink to a printing medium.

2. Description of the Related Art

Inkjet print heads (hereinafter also referred to as print head) installed in inkjet printing apparatus eject ink droplets from ejection openings by a variety of techniques, and print by causing the ink droplets to adhere to a print medium, such as printer paper. Among these, it is relatively easy to realize a high-density, multi-nozzle configuration for inkjet print heads that use heat as the energy for ejecting ink, thereby enabling high-resolution, high-image-quality, and high-speed printing.

In recent years, in order to make inkjet print heads more compact and dense, print heads are being used wherein semiconductor fabrication technology is used to internally house an electric control circuit in the print head substrate. The electric control circuit is used to drive ink ejection energy-generating elements. In order to supply ink to a plurality of ejection openings, such inkjet print heads are constructed such that the substrate is pierced from the back surface so that each nozzle communicates with a common ink supply port, thereby supplying ink to individual nozzles from the common ink supply port.

In order to manufacture such inkjet print heads capable of high-quality printing, a manufacturing method for creating an inkjet print head has been disclosed, wherein the dimensions between the nozzles and the ejection energy-generating elements for ejecting ink from the nozzles is controlled with high precision (see Japanese Patent Laid-Open No. H06-286149 (1994), for example). In addition, when using a silicon substrate for the inkjet print head substrate, the formation of an ink supply port using anisotropic etching technology has also been disclosed (see Japanese Patent Laid-Open No. H09-011479(1997), for example).

Meanwhile, one reliability factor sought for inkjet print heads is the suppression of dust or other foreign matter infiltrating the nozzles. The cause of dust or foreign matter infiltration is thought to be the contamination of the insides of nozzles by dust or foreign matter during the print head manufacturing process, or by dust or foreign matter being sent together with ink and thereby infiltrating the nozzles.

In order to prevent such infiltration of dust or foreign matter into the nozzles, the provision of a filter onto an inkjet print head has been disclosed.

FIG. 6 is a plan view illustrating an inkjet print head substrate of the related art. Two rows of heaters 6 are disposed along the lengthwise direction of the ink supply port 2. Electrical conducting layers 7 are disposed symmetrically with the heater rows with respect to the ink supply port. A plurality of filter pores 8 are formed on the ink supply port 2.

As one method for manufacturing such a print head, technology has been disclosed wherein, on the substrate surface where the heaters are provided, a resistive material layer is provided at the time of etching the ink supply port, and then a plurality of pores in the resistive material layer are provided, thereby forming a filter and an ink supply port at the same time. (see U.S. Pat. No. 6,264,309, for example). In addition, technology has been disclosed wherein, at the time of forming an ink supply port on a silicon substrate, side etching is used to simultaneously form a membrane filter through an etching-resistant mask applied to the surface opposite to the surface where the heaters are provided (see Japanese Patent Laid-Open No. 2000-094700, for example). Furthermore, technology has been disclosed wherein a membrane filter is provided on the ink supply port portion on the same side of the silicon substrate where the heaters are provided (see Japanese Patent Laid-Open No. 2005-178364, for example).

Meanwhile, in recent inkjet printing apparatus, while droplet sizes of ejected ink are being decreased in order to obtain high-quality images, increased printing speed is also sought. Furthermore, as the printing speed increases, the effects of flow resistance caused by the filter pores become an object of concern.

In order to realize increased printing speed, a sufficient ink flow volume to each bubble chamber must be secured by increasing the surface area of the ink supply port. However, the surface area of the substrate also increases as a result of increasing the surface area of the ink supply port, which leads to higher costs.

One means for holding enlargement of the substrate surface area in check while also securing ink flow volume sufficient to realize high-speed printing involves increasing the filter diameter, while lowering the flow resistance of the membrane portion. However, if the filter diameter is increased, then the mechanical strength of the membrane filter itself decreases. For this reason, the filter may tear, and as a result, yield decreases.

SUMMARY OF THE INVENTION

The present invention was made in consideration of the circumstances described above. It is an object of the present invention to provide a print head reduced in size and able to perform high-image-quality, high-speed printing.

A liquid ejecting head in accordance with an embodiment of the present invention that achieves the above object is provided with: a substrate, having elements that generate energy used to eject liquid from ejection openings, and provided with a liquid supply port that communicates with a surface of the substrate having the elements and an opposite surface thereof; a member, provided above the surface of the substrate, and having walls of a liquid flow path that communicate with ejection openings and the supply port; an insulating layer, provided so as to cover the supply port, and provided with a plurality of through-holes; and a conducting layer electrically coupled to the elements, and provided within the insulating layer so as to be insulated with respect to the liquid.

According to the above configuration, enlargement of the surface area of an inkjet print head is held in check, thereby allowing the inkjet print head to be made more compact, while also improving the reliability of the inkjet print head due to improved filter mechanical strength.

Further features of the present invention will become apparent from the following description of exemplary embodiments (with reference to the attached drawings).

BRIEF DESCRIPTION OF THE DRAWINGS

FIGS. 5A to 5E are schematic cross-section diagrams illustrating steps in a process for manufacturing a print head in accordance with an embodiment of the present invention;

DESCRIPTION OF THE EMBODIMENTS

Hereinafter, embodiments of the present invention will be described in detail and with reference to the accompanying drawings.

(First Embodiment)

Figure 1:
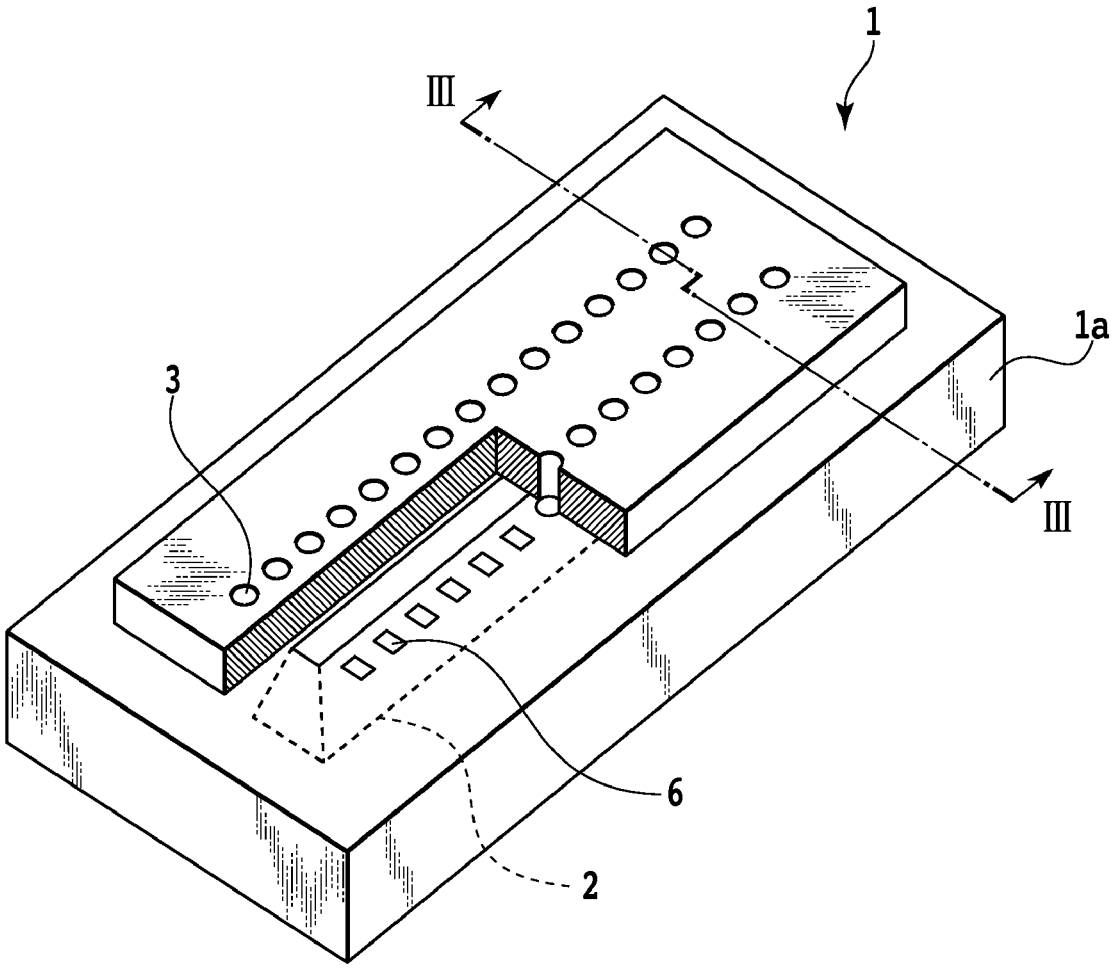
FIG. 1 is a perspective diagram schematically illustrating a cutaway view of a print head in accordance with an embodiment of the present invention.

FIG. 1 is a perspective diagram schematically illustrating a cutaway view of the print head of the present embodiment. Upon a Si substrate 1*a* constituting a print head 1, an ink supply port 2 is formed elongated along the lengthwise direction of the Si substrate 1*a* and piercing the Si substrate 1*a* from the back surface to the front surface. In addition, on the back surface of the Si substrate 1*a* a plurality of ejection openings 3, as well as a flow path communicating between each ejection opening and the ink supply port 2, are formed by a flow path forming member. Upon the flow path, there are provided heaters 6, which act as energy generating elements for generating energy for using ejecting ink from ejection openings.

More specifically, on the front surface of the Si substrate 1*a*, a large number of heaters 6 are provided as two parallel heater rows. The heaters in the heater rows are disposed along the lengthwise direction of the Si substrate 1*a* at a fixed pitch. The ink supply port 2 is provided along the two heater rows and opens onto the front surface of the Si substrate 1*a* between. In addition, each ejection opening 3 is positioned above a particular heater 6. When a voltage is applied to the heaters 6, ink supplied from the ink supply port 2 into flow path is ejected from the ejection openings 3.

Figure 2A:
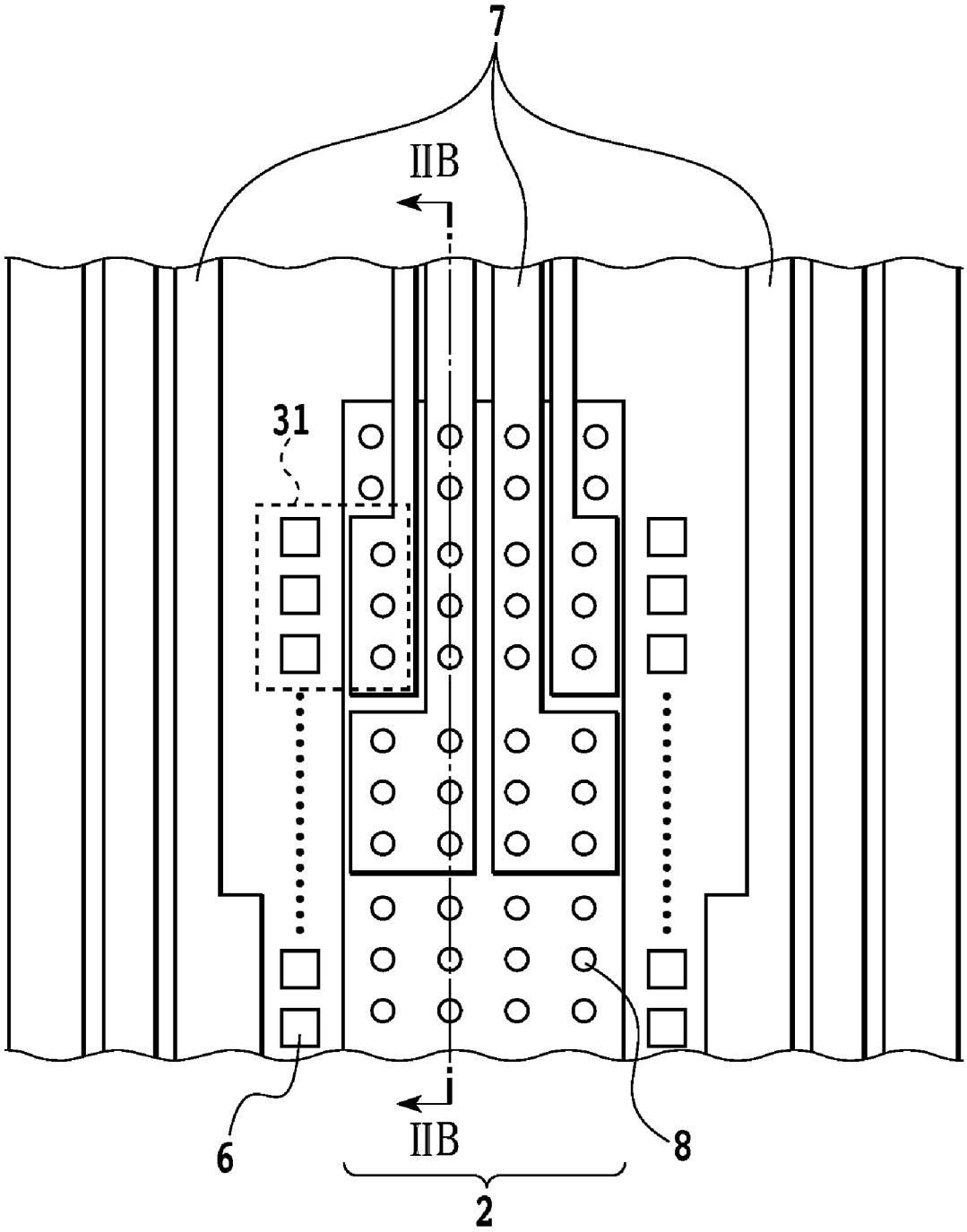
FIGS. 2A and 2B are plan views illustrating an inkjet print head in accordance with an embodiment of the present invention.

FIG. 2A is a plan view illustrating an inkjet print head (i.e., the Si substrate 1*a*) of the present embodiment. Upon the print head substrate of the present embodiment, two rows of heaters 6 are disposed along the lengthwise direction of the ink supply port 2. Upon the ink supply port 2, an insulating layer is provide so as to cover the ink supply port 2 and there is formed a membrane filter 9 by providing a plurality of filter pores 8 for use as a plurality of through-holes on the insulating layer. In addition, conducting layers 7 are also disposed in the ink supply port area. The filter pores 8 are formed to inhibit dust or foreign matter in the ink entering into the ink flow path or the ejection openings 3.

Figure 3:
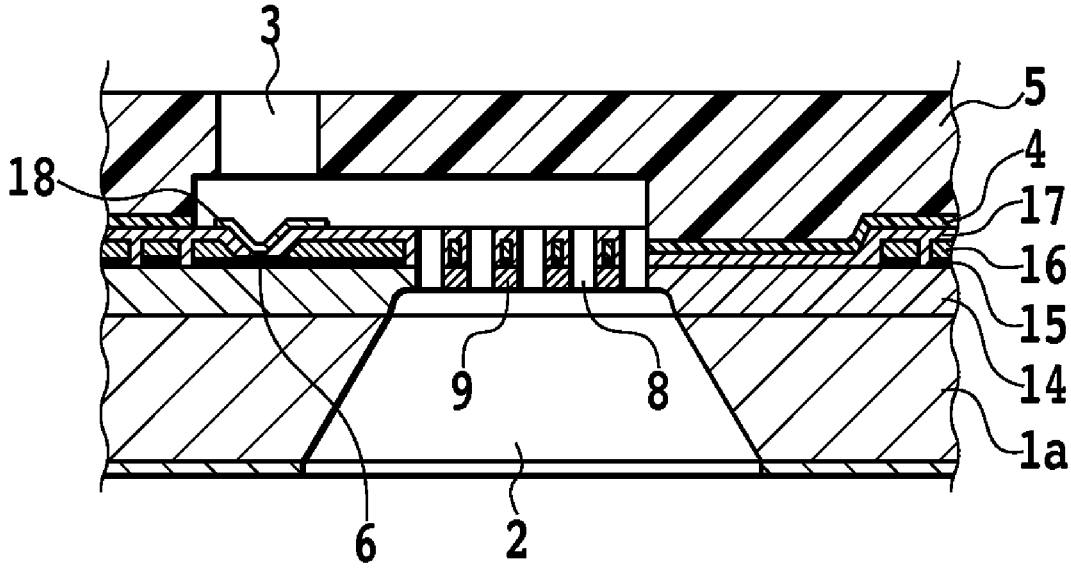
FIG. 3 is a cross-section diagram of the inkjet print head shown in FIG. 1, taken along the line III-III.

FIG. 3 is a cross-section diagram of the inkjet print head 1 shown in FIG. 1, taken along the line III-III. On the front side of the Si substrate 1*a*, the following layers are formed in order: a first conducting layer (not shown), an insulating layer 14, a thermal resistor layer 15, a second conducting layer 16, a protective layer 17, and a cavitation resistance layer 18. On top of the inkjet printing head substrate as above, a polyetherimide resin layer 4 and a coated resin layer (i.e., a nozzle forming member) 5 are also formed, thereby forming the ink flow path and the ejection openings 3. In addition, on the back side of the Si substrate, a thermal oxidation layer (i.e., an oxide silicon film) is formed, and is used as a mask when forming the ink supply port 2.

The first conducting layer (not shown) is formed from a metal such as aluminum or an aluminum-containing alloy, and primarily forms the drive circuitry. The insulating layer 14 is formed from a SiO or similar film, and functions as an inter-layer insulating layer between the first conducting layer (not shown) and the second conducting layer 16. The thermal resistor layer 15 is formed from TaSi or TaSiN, for example, and constitutes the heaters 6. The second conducting layer 16 is formed from a metal such as aluminum or an aluminum-containing alloy, and primarily supplies a voltage supplied from a power supply voltage to the heaters 6, and also constitutes the heaters 6. The protective layer 17 is formed from silicon nitride or similar material, and is used to protect the heaters 6 and the drive circuitry (not shown). The cavitation resistance layer 18 is formed from Ta or similar material. The cavitation resistance layer 18 is formed in regions corresponding to the heaters 6, and prevents degradation of the protective layer 17 due to cavitation phenomena occurring in ink. Furthermore, the protective layer 17 also functions as an insulating layer that insulates the heaters 6 from the cavitation resistance layer 18. In addition, the polyetherimide resin layer 4 also functions as an adhesion-improving layer between the substrate and the coated resin layer 5.

The filter pores 8 are formed by provided the through-holes in the insulating layer 14 and the protective layer 17 using as insulating layer of the ink supply port area. In addition, a membrane filter 9 is constructed by providing the plurality of filter pores 8 in the insulating layer 14, the thermal resistor layer 15, the second conducting layer 16, and the protective layer 17. It should be appreciated that the second conducting layer 16 is formed in the inside of the membrane filter 9 to be included by insulating layer so as to be in an insulated condition. The second wiring filter does not function to inhibit dust or foreign matter in ink entering into the ink flow path or the ejection openings 3, but is instead a part of the conducting layer area. Furthermore, the filter pores 8 are enveloped by the insulating layer 14 and the protective layer 17, thereby forming a configuration wherein the thermal resistor layer 15 and the second conducting layer 16 do not come into contact with the ink. The second conducting layer 16 is provided so that the circumference of the filter pores 8 may be surrounded. In addition, filter performance is determined by the pore diameter and pitch of the filter pores 8. For example, performance as a filter improves with smaller pore diameters and the appropriate resistance is generated because the area of being provided the second conducting layer 16 becomes large. However, if the pore diameter is too small, then ink pressure drops are produced in the membrane filter portion, which may lead to worsened ink flow. Consequently, it is preferable to determine the pore diameter according to factors such as the size of the dust or foreign matter expected to become trapped, as well as the characteristics of the ink to be used.

Next, a process for manufacturing the print head substrate of the present embodiment will be described. FIGS. 4A to 4D and FIGS. 5A to 5E are schematic cross-section diagrams illustrating steps for manufacturing the print head substrate of the present embodiment. Each of the diagrams in FIGS. 4A to 4D and FIGS. 5A to 5E illustrates a cross-section taken along the line III-III shown in FIG. 1.

Figure 4A:
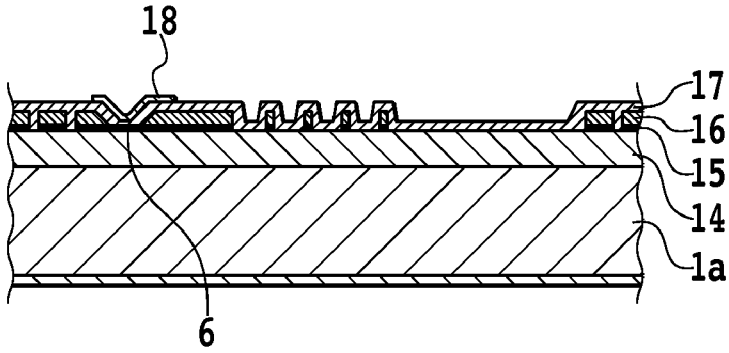
FIGS. 4A to 4D are schematic cross-section diagrams illustrating steps in a process for manufacturing a print head in accordance with an embodiment of the present invention.

The Si substrate 1*a* in FIG. 4A has a <100>-oriented crystal structure. It should be appreciated that although a <100>-oriented Si substrate 1*a* is described by way of example in the present embodiment, the orientation of the Si substrate 1*a* of the present invention is not limited to the above.

First, the insulating layer 14 is formed on the front surface of the Si substrate 1*a*. The insulating layer 14 is made up of a silicon oxide film, for example. On top of the insulating layer 14, the thermal resistor layer 15 and the second conducting layer 16 are formed, thereby constructing the plurality of heaters 6, together with the electric signal circuitry (not shown). At this point, the second conducting layer 16 and the thermal resistor layer 15 are etched into desired shapes at the portions that will become the filter pores 8. On top of the above layers, a protective layer 17 of silicon nitride or similar material is deposited over the entire surface as a protective film for the heaters 6 and the electric signal circuitry. In addition, the cavitation resistance layer 18 is formed on top of the heaters 6. The thicknesses of the insulating layer 14, the protective layer 17, and the cavitation resistance layer 18 are thicknesses that ensure a balance between thermal radiation and thermal storage of the heat produced by the heaters 6, thereby causing print head functionality to be exhibited. For example, the film thickness of the insulating layer 14 may be 0.9 μm, the film thickness of the protective layer 17 may be 0.3 μm, and the film thickness of the cavitation resistance layer 18 may be 0.2 μm. In addition, on the back surface of the Si substrate 1*a*, an etching-resistant mask made up of an insulating layer such as a silicon oxide film or silicon nitride film is formed over the entire surface.

Figure 4B:
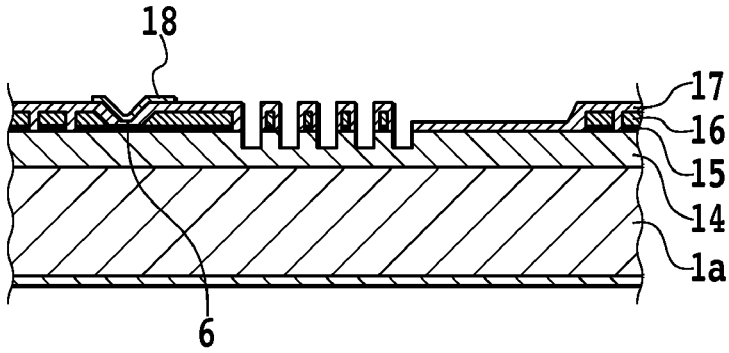

Next, as shown in FIG. 4B, patterning of the protective layer 17 is conducted, thereby forming electrode pads (not shown) for connecting to the main apparatus. At this point, the portions of the protective layer 17 and the insulating layer 14 that will become the filter pores 8 are removed simultaneously with the formation of the electrode pads. However, the insulating layer 14 is not completely etched away, and approximately ½ of the initial film thickness is left over, for example.

Figure 4C:
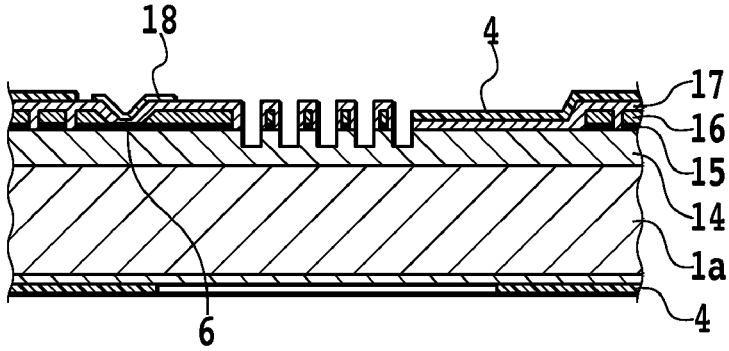

Next, as shown in FIG. 4C, polyetherimide resin layers 4 are respectively formed on the protective layer 17 on the front side of the Si substrate 1*a*, as well as on the etching-resistant mask (i.e., the insulating layer) on the back side, and then predetermined patterning is conducted. The polyetherimide resin layers 4 are made up of a heat-reversible resin. The polyetherimide resin layers 4 perform the role of improving the adhesion of the coated resin layer 5, to be hereinafter described, that acts as the nozzle forming member. For this reason, the polyetherimide resin layers 4 are also referred to as the "adhesion-improving layers". In the present embodiment, a heat-reversible polyetherimide (Hitachi Chemical Co., Ltd., product name: HL-1200) is used as the material of the adhesion-improving layers 4. The adhesion-improving layers 4 can be formed as shown in FIG. 4C, wherein the heat-reversible polyetherimide is applied to both surfaces of the Si substrate 1*a* by spin coating or a similar technique, and then a positive resist (not shown) is formed on top and patterned. In the present embodiment, the film thickness of the adhesion-improving layers 4 is 2 μm.

Figure 4D:
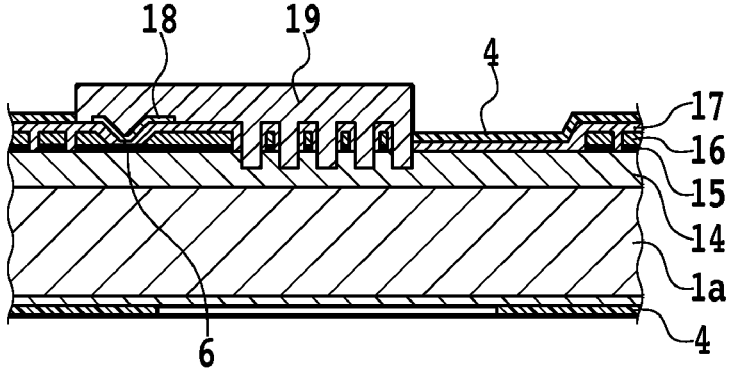

Next, as shown in FIG. 4D, on the front surface of the Si substrate 1*a* where the heaters 6 are constructed, a pattern layer 19 that will become ink flow path portion is formed using a soluble resin. Deep-UV resist (Tokyo Ohka Kogyo Co., Ltd., product name: ODUR) may be used as the soluble resin, for example. After applying the soluble resin to the front surface of the Si substrate 1*a* by spin coating or a similar technique, the soluble resin is exposed by Deep-UV light and developed, thereby forming the pattern layer 19.

Next, as shown in FIG. 5A, a coated resin layer 5 made up of a photosensitive resin is formed on the pattern layer 19 by spin coating or a similar technique. Furthermore, a photosensitive, water-repellent layer (not shown) made up of a dry film is provided on the coated resin layer 5. Subsequently, the coated resin layer 5 and the water-repellant layer (not shown) are exposed by ultraviolet rays, Deep-UV light, or similar light, and then developed, thereby forming the ejection openings 3.

Next, as shown in FIG. 5B, the front and lateral surfaces of the Si substrate 1*a*, upon which layers such as the pattern layer 19 and the coated resin layer 5 have been patterned, are covered with a protective layer 20 applied by spin coating or a similar technique. The protective layer 20 is made up of a material sufficiently resistant to the strongly alkaline solution used at the time of conducting anisotropic etching of the Si substrate 1*a* in a later step. For this reason, it is possible to prevent layers such as the coated resin layer 5 from degrading at the time of conducting anisotropic etching. The insulating layer on the back side of the Si substrate 1*a* is then patterned by conducting wet etching or a similar process, with the polyetherimide resin layer 4 as a mask. In so doing, the starting surface for anisotropic etching is exposed on the back side of the Si substrate 1*a*.

Next, as shown in FIG. 5C, the ink supply port 2 is formed on the Si substrate 1*a*. The ink supply port 2 is formed by anisotropically etching the Si substrate 1*a* using a strongly alkaline solution such as TMAH (tetramethylammonium hydroxide) or KOH (potassium hydroxide), for example. Subsequently, the polyetherimide resin layer on the back surface of the Si substrate 1*a* is removed by dry etching or a similar technique.

Next, as shown in FIG. 5D, the portions of the insulating layer 14 that will become the filter pores 8 are completely removed by wet etching, thereby forming the membrane filter 9.

Next, the protective layer 20 is removed as shown in FIG. 5E. Additionally, by causing the material of the pattern layer 19 (i.e., the heat-reversible resin) to elute through the ejection openings 3 and the ink supply port 2, the ink flow path and the bubble chambers are formed between the Si substrate 1*a* and the coated resin layer 5. The heat-reversible resin constituting the pattern layer 19 is developed and softened by exposing the entire wafer surface to Deep-UV light. At the time of development, the wafer may also be ultrasonically immersed as necessary. As a result of the above, the pattern layer 19 (i.e., the heat-reversible resin) can be made to elute through the ejection openings 3 and the ink supply port 2. Subsequently, the water is spun at high speed to blow off the fluid used for ultrasonic immersion, and then the interiors of the ink flow path and the bubble chambers are dried.

The wafer, having nozzle portions formed thereon by the above steps, is then cut into chips by a dicing saw or similar equipment. Each chip is then joined to electric wiring (not shown) for driving the heaters 6. Subsequently, a chip tank member (not shown) for storing ink supplied to the ink supply port 2 is joined to each chip on the side of the ink supply port 2, thereby completing the inkjet print head.

In the inkjet print head of the present embodiment thus fabricated, enlargement of the substrate surface area is controlled.

For example, in the case of forming a membrane filter on the substrate, the ink supply port surface area is reduced by approximately 20% compared to the case without a membrane filter. More specifically, in a substrate of the related art, an area of 910 μm is required for the ink supply port in the case where there is no membrane filter, wherein the width of the ink supply port formed on the substrate is 110 μm, and wherein the width of the conducting layers is 800 μm. In the case of forming a membrane filter, if the decreased portion of the ink supply port surface area is expanded in the widthwise direction, then the width of the ink supply port becomes 143 μm. Thus, an area of 943 μm becomes necessary for a single ink supply port. Consequently, in the case of forming a membrane filter, the substrate surface area is increased by approximately 4% compared to the case wherein a membrane filter is not formed.

In contrast, in the substrate configured according to the present embodiment, the ink supply port width is 143 μm, and the conducting layer width is 822 μm, taking into account the increased portion of line resistance as a result of disposing the conducting layers in the membrane filter area. Herein, since the ink supply port area and the conducting layer area are overlapping, the area required for a single ink supply port becomes 822 μm.

In other words, in the substrate configured according to the present embodiment, the substrate surface area is reduced by approximately 10%, even when compared to a substrate of the related art that does not have a membrane filter.

Furthermore, the substrate of the present embodiment includes conducting layers formed from metal as one portion of the material constituting the membrane filter. As a result, mechanical strength is improved over that of a membrane filter of the related art. For this reason, the reliability of the inkjet print head is improved.

Figure 2B:
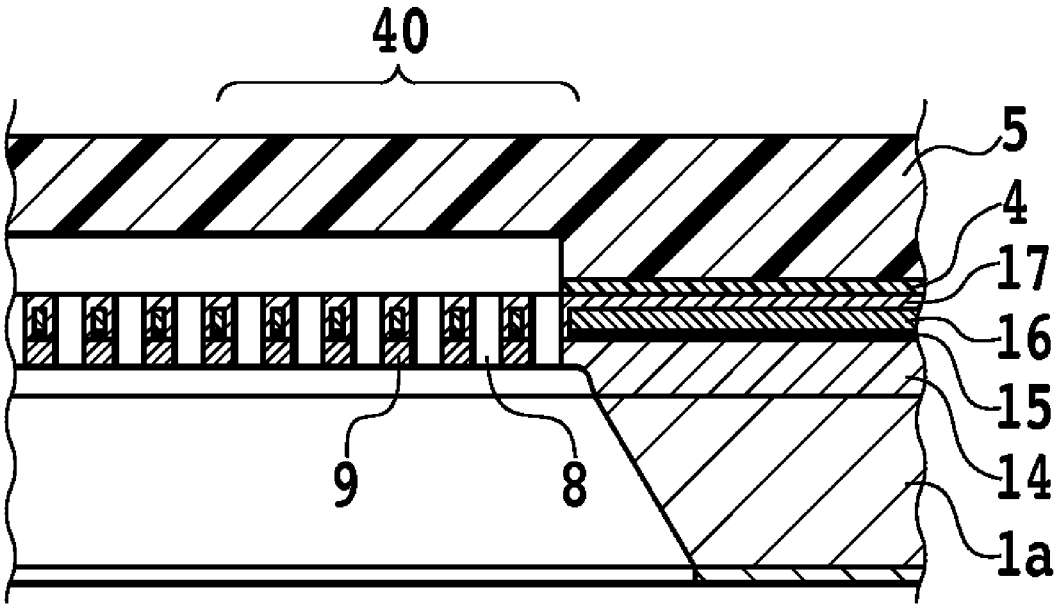

Next, the positional relationships of the wires provided on the membrane filter will be described with reference to FIGS. 2A and 2B. FIG. 2B illustrates a cross-section of that shown in FIG. 2A, taken along the line IIB-IIB. In the case wherein a resin is used for forming the ejection openings 3 as in the present invention, the coated resin layer 5 (a thick resin film) exhibits changes in shape due to temperature or humidity that are greater than that of the Si substrate 1*a*. The temperature of the inkjet print head is high, particularly in the case of using the heaters 6 for ejection, and humidity is also very high. In this state, warping occurs in the substrate due to the difference in the amount of deformation between the coated resin layer 5 and the Si substrate 1*a*. The stress due to such warping is concentrated at the edge portions of the coated resin layer 5, such as the outer edges of the supply port, and works to break the thin membrane filter as a result of the coated resin layer 5. At this point, since resin-only portions in particular are long in the direction parallel to the rows of ejection openings, the amount of displacement of the coated resin layer 5 becomes large, and a large stress is induced at the end 40 of supply port positioned at the boundary between the membrane filter and the coated resin layer 5, as shown in FIG. 2B. In this way, by disposing wires in a concentrated manner at the edge portions of the supply port as shown in FIG. 2A, the mechanical strength can be increased, and filter damage can be prevented.

In addition, when wiring the heaters 6 with the wires 7 divided as shown in FIG. 2A, the resistance of the wires 7 is preferably equal for each wire, in order to regularize the amount of energy applied to the heaters. However, if wires are simply formed using the same wire widths, then resistance values will become too low at the edges of the supply port near the pads, while in contrast, the resistance values of the wires will become too high in the center of the supply port. Normally, the resistance values are matched by changing wire widths. If wires are formed in the membrane filter portion, then the wire resistance increases to the extent that filter pores are formed. If wires are drawn over the membrane filter up to the center of the ink supply port 2 looking in the direction in which the ejection openings 3 are arranged, then it becomes necessary to increase wire widths in the direction orthogonal to the direction in which the ejection openings 3 are arranged. For this reason, it is preferable to form the wires provided in the upper portion of the membrane filter at the edge of the ink supply port 2 looking in the direction in which the ejection openings 3 are arranged, as shown in FIG. 2A, where the wires are not largely affected by the filter pores. By providing the wires 7 to connect to the edges of the heaters 6 at the edge of the filter looking in the direction orthogonal to the direction in which the ejection openings 3 are arranged, the width of the wires 7 can be set to the width in the direction orthogonal to the direction in which the ejection openings 3 are arranged. In so doing, a more compact substrate can be achieved.

Figure 6:
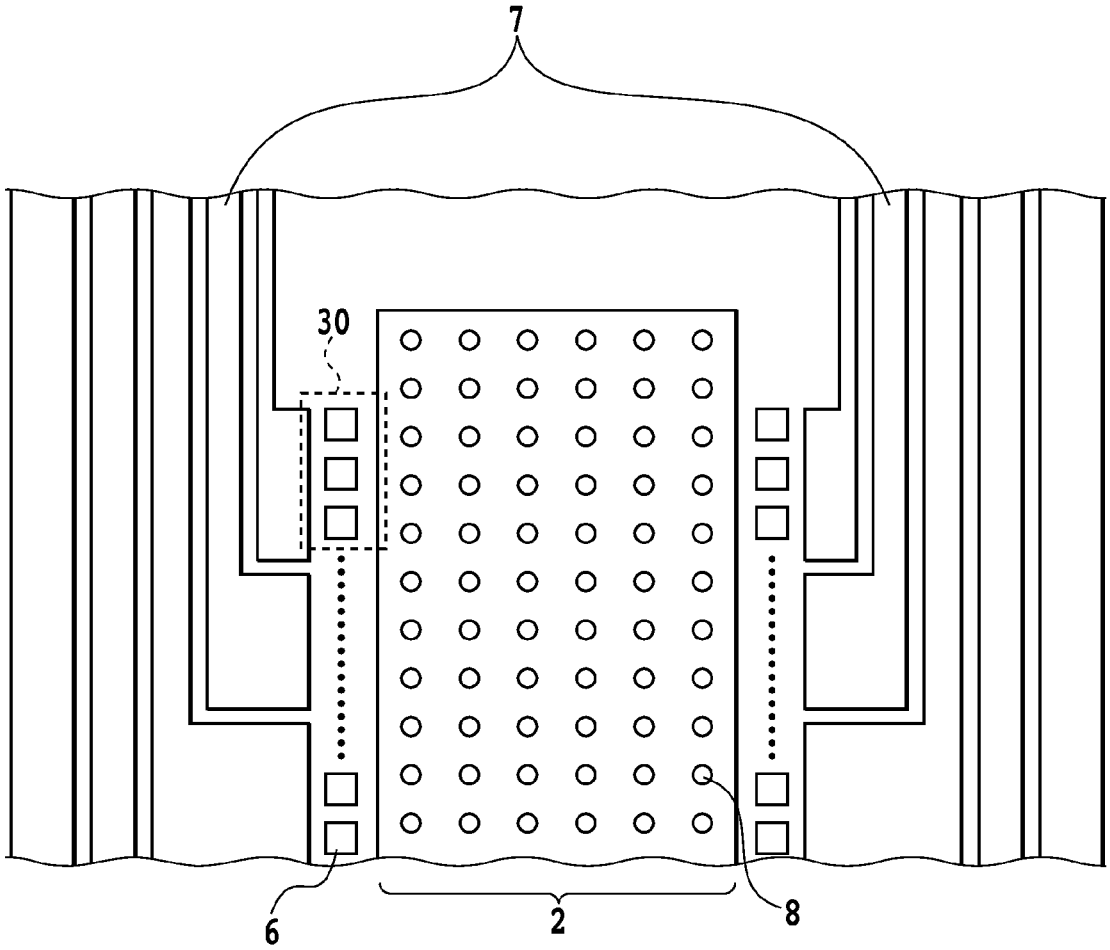
FIG. 6 is a plan view illustrating an inkjet print head of the related art.
Figure 7A:
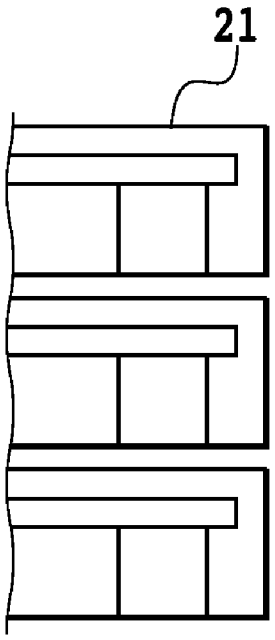
FIG. 7A is an enlarged view of the portion labeled 30 in FIG. 6.

FIG. 7A is an enlargement of the portion labeled 30 in FIG. 6, and illustrates how the heaters 6 and the wires 7 are joined in the related art. Both anode side wires and cathode side wires are formed opposite to the supply port with respect to the heaters 6. As is apparent from FIG. 7A, even if it is attempted to increase the arrangement density of the heaters, the arrangement of the heaters 6 is nevertheless limited, due to the necessity of the wires 21 returning on the opposite side of the supply port.

Figure 7B:
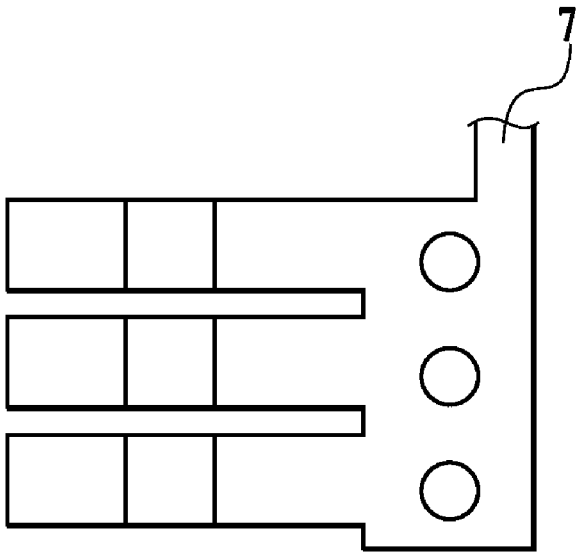
FIG. 7B is an enlarged view of the portion labeled 31 in FIG. 2A.

Meanwhile, FIG. 7B is an enlargement of the portion labeled 31 in FIG. 2A. If the present invention is used, it becomes possible to divide and arrange the wires connecting the anode side and the wires connecting to the cathode side on either side of the heaters. For this reason, as shown in FIG. 7B, the wires 21 returning on the opposite side of the supply port becomes unnecessary, and the heater arrangement density can be increased. In so doing, it becomes possible to form images with finer detail.

A control element that controls on/off of voltages for the heaters 6 is also formed on the substrate farther away from the ink supply port 2 than the heaters 6. For the control element that controls the heaters, nMOS is used, which performs well for continuously flowing current. The wires connecting the anode side are connected to the wires in the membrane filter portion via the heaters. Accordingly, the wires in the membrane filter portion are used between the wires of anode side of the heater 6 and anode side of the nMOS.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-157876, filed Jun. 17, 2008, which is hereby incorporated by reference herein in its entirety.

What is claimed is:

1. A liquid ejecting head, comprising:

a substrate, having elements that generate energy used to eject liquid from ejection openings, and provided with a liquid supply port that communicates with a surface of the substrate having the elements and an opposite surface thereof;

a member, provided above the surface of the substrate, and forming walls of a liquid flow path and the ejection openings;

an insulating layer, provided between the substrate and the member so as to cover the liquid supply port, and having a plurality of through-holes for conducting ink between the liquid flow path and the liquid supply port; and a conductive layer electrically coupled to the elements, wherein a part of the conductive layer is covered by a portion of the insulating layer provided with the plurality of the through-holes so as to be insulated from the liquid.

2. The liquid ejecting head according to claim 1, wherein the insulating layer is provided above the elements in order to insulate the elements from the liquid, as well as successive layers.

3. The liquid ejecting head according to claim 1, wherein the insulating layer includes a silicon oxide film and a silicon nitride film, and the conductive layer is provided between the silicon oxide film and the silicon nitride film.

4. The liquid ejecting head according to claim 3, wherein the elements are provided between the silicon oxide film and the silicon nitride film.

5. The liquid ejecting head according to claim 1, wherein the conductive layer contains aluminum.

6. The liquid ejecting head according to claim 1, wherein the liquid ejecting head is provided with a column of a plurality of elements, the liquid supply port is provided along the column, and the conductive layer is provided near through-holes positioned at both ends of the liquid supply port in the arrayed direction of the column.

7. The liquid ejecting head according to claim 1, wherein a part of the conductive layer is used as a conductive layer on an anode side between the elements and an nMOS that controls current output to the elements.

* * * * *